US009319767B2

(12) United States Patent
Sakaguchi et al.

(10) Patent No.: US 9,319,767 B2
(45) Date of Patent: Apr. 19, 2016

(54) EARPHONE

(71) Applicant: Panasonic Intellectual Property Management Co., Ltd., Osaka (JP)

(72) Inventors: Atsushi Sakaguchi, Osaka (JP); Shuji Saiki, Nara (JP); Toshiyuki Matsumura, Osaka (JP); Sawako Kano, Hyogo (JP); Akiko Fujise, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/003,892

(22) PCT Filed: Jan. 29, 2013

(86) PCT No.: PCT/JP2013/000471
§ 371 (c)(1),
(2) Date: Sep. 9, 2013

(87) PCT Pub. No.: WO2013/114864
PCT Pub. Date: Aug. 8, 2013

(65) Prior Publication Data

US 2014/0056455 A1 Feb. 27, 2014

(30) Foreign Application Priority Data

Jan. 30, 2012 (JP) ..... 2012-016760

(51) Int. Cl.
*H04R 25/00* (2006.01)
*H04R 1/10* (2006.01)
*H04R 1/28* (2006.01)
(Continued)

(52) U.S. Cl.
CPC ..... *H04R 1/10* (2013.01); *H04R 1/2811* (2013.01); *H04R 25/02* (2013.01); *H04R 25/48* (2013.01); *H04R 1/1016* (2013.01); *H04R 9/027* (2013.01)

(58) Field of Classification Search
None
See application file for complete search history.

(56) References Cited

U.S. PATENT DOCUMENTS 4,058,688 A * 11/1977 Nishimura et al. ..... 381/372
4,742,887 A * 5/1988 Yamagishi ..... 181/129
(Continued)

FOREIGN PATENT DOCUMENTS

JP 62-141293 9/1987
JP 11-308685 11/1999
(Continued)

OTHER PUBLICATIONS

International Search Report mailed Mar. 26, 2013 in International (PCT) Application No. PCT/JP2013/000471.
(Continued)

*Primary Examiner* — Davetta W Goins
*Assistant Examiner* — Phylesha Dabney
(74) *Attorney, Agent, or Firm* — Wenderoth, Lind & Ponack, L.L.P

(57) ABSTRACT

An earphone includes: a loudspeaker unit; a sound conductive tube which is connected to a front surface having a diaphragm included in the loudspeaker unit, and has a hole through which a sound generated from the loudspeaker unit is emitted; a housing which is connected to a back surface of the loudspeaker unit so that a space is formed between the housing and the back surface of the loudspeaker unit, and has a first air hole connecting the space to external air; a first braking part which closes a sound hole of the loudspeaker unit; and a second braking part which closes the first air hole.

6 Claims, 15 Drawing Sheets

(51) Int. Cl.
*H04R 25/02* (2006.01)
*H04R 9/02* (2006.01)

(56) References Cited

U.S. PATENT DOCUMENTS

| | | | | |
|---|---|---|---|---|
| 7,149,323 | B2 * | 12/2006 | Yamagishi | 381/415 |
| 7,447,308 | B2 * | 11/2008 | Tsai | 379/430 |
| 8,611,581 | B2 * | 12/2013 | Matsuo et al. | 381/380 |
| 8,670,586 | B1 * | 3/2014 | Boyle et al. | 381/370 |
| 8,885,866 | B2 * | 11/2014 | Sakaguchi et al. | 381/382 |
| 2006/0093180 | A1 * | 5/2006 | Kim | 381/412 |
| 2007/0189569 | A1 * | 8/2007 | Haapapuro | H04R 1/1016 381/380 |
| 2007/0201717 | A1 * | 8/2007 | Dyer et al. | 381/380 |
| 2009/0285437 | A1 * | 11/2009 | Takigawa et al. | 381/380 |
| 2010/0166245 | A1 | 7/2010 | Takigawa et al. | |
| 2014/0056455 | A1 * | 2/2014 | Sakaguchi et al. | 381/328 |
| 2014/0348372 | A1 * | 11/2014 | Seo et al. | 381/380 |

FOREIGN PATENT DOCUMENTS

| | | |
|---|---|---|
| JP | 2008-283398 | 11/2008 |
| JP | 2010-4513 | 1/2010 |
| JP | 2010-283643 | 12/2010 |
| JP | 2011-082702 | 4/2011 |
| JP | 2011-182201 | 9/2011 |
| WO | 97/47117 | 12/1997 |

OTHER PUBLICATIONS

Extended European Search Report issued Dec. 22, 2014 in corresponding European Patent Application No. 13744295.0.

* cited by examiner

100

600

EARPHONE

TECHNICAL FIELD

The present disclosure relates to earphones. More particularly, the present disclosure relates to earphones capable of adjusting sound pressure frequency characteristics.

BACKGROUND ART

In recent years, a small-size loudspeaker unit has been proposed, in which the minimum resonance frequency of the loudspeaker unit is reduced to several hundreds of Hz by using a magnetic fluid. In televisions and mobile phones, use of such a loudspeaker unit can increase the low frequency band characteristics, as compared to conventional loudspeaker units. However, when the loudspeaker unit having the reduced minimum resonance frequency is used in equipment such as earphones in which the loudspeaker unit is driven in a closed space surrounded by an eardrum and an external auditory canal, the low frequency band characteristics become excessive as compared to the high frequency band characteristics, and therefore, the sound pressure frequency characteristics need to be adjusted in some way.

As a method for adjusting the sound pressure frequency characteristics of the conventional earphones, a method has been proposed, in which a space is provided at a back surface of the loudspeaker unit. As a prior art literature relating to the present disclosure, for example, Patent Literature 1 has been known, which discloses a configuration of an earphone in which a space is provided on a back surface of a loudspeaker unit in a housing in which the loudspeaker unit is installed, and the volume of the space provided at the back surface of the loudspeaker unit is adjusted to adjust the sound pressure frequency characteristics.

CITATION LIST

Patent Literature

[PTL 1] Japanese Laid-Open Patent Publication No. 2008-283398

SUMMARY OF THE INVENTION

Problems to be Solved by the Invention

In the configuration of the conventional earphone, by providing the space at the back surface of the loudspeaker unit, the minimum resonance frequency of the loudspeaker unit can be increased. Thereby, in the loudspeaker unit having the low minimum resonance frequency, a difference in sound pressure levels between a frequency range lower than the minimum resonance frequency and a frequency range higher than the minimum resonance frequency is improved. However, with increase in the minimum resonance frequency, a Q value in the minimum resonance frequency increases, and an undesirable peak is generated. Further, in the configuration of the conventional earphone, in the frequency range lower than the minimum resonance frequency, the sound pressure level becomes constant, and therefore, the sound pressure frequency characteristics in the low frequency range cannot be freely adjusted.

The present disclosure takes into consideration the above problems, and has an object to provide an earphone capable of suppressing a peak that occurs when the minimum resonance frequency increases, and freely adjusting the sound pressure frequency characteristics in the low frequency range.

Solution to the Problems

To achieve the above object, an earphone according to an aspect of the present disclosure includes: a loudspeaker unit; a sound conductive tube which is connected to a front surface having a diaphragm included in the loudspeaker unit, and has a hole through which a sound generated from the loudspeaker unit is emitted; a housing which is connected to a back surface of the loudspeaker unit so that a space is formed between the housing and the back surface of the loudspeaker unit, and has a first air hole connecting the space to external air; a first braking part which closes a sound hole of the loudspeaker unit; and a second braking part which closes the first air hole.

Advantageous Effects of the Invention

According to the present disclosure, an earphone having a space provided at a back surface of a loudspeaker unit can realize the sound pressure frequency characteristics suitable for the earphone by using two braking parts.

DESCRIPTION OF EMBODIMENTS

Figure 15:
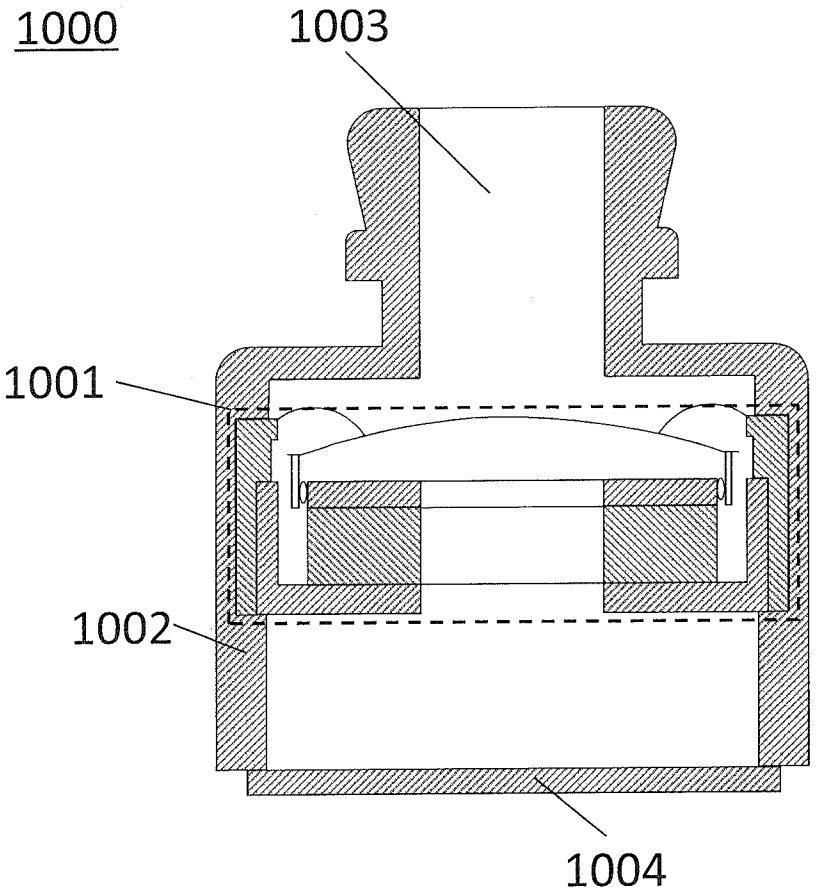
FIG. 15 PRIOR ART
FIG. 15 is a schematic cross-sectional diagram showing the configuration of the conventional earphone.

In order to describe the problems to be solved by the present disclosure, the conventional earphone disclosed in Patent Literature 1 will be described with reference to the drawings. FIG. 15 is a schematic cross-sectional diagram showing the configuration of the conventional earphone 1000. The conventional earphone 1000 includes a loudspeaker unit 1001, a housing 1002, a sound output hole 1003 provided through the housing 1002, and a back surface panel 1004 fitted to the housing 1002. A user replaces the back surface panel 1004 of the earphone 1000 to adjust the volume of the back surface space formed by the loudspeaker unit 1001, the housing 1002, and the back surface panel 1004, and thus the user can select a desired minimum resonance frequency.

Figure 16:
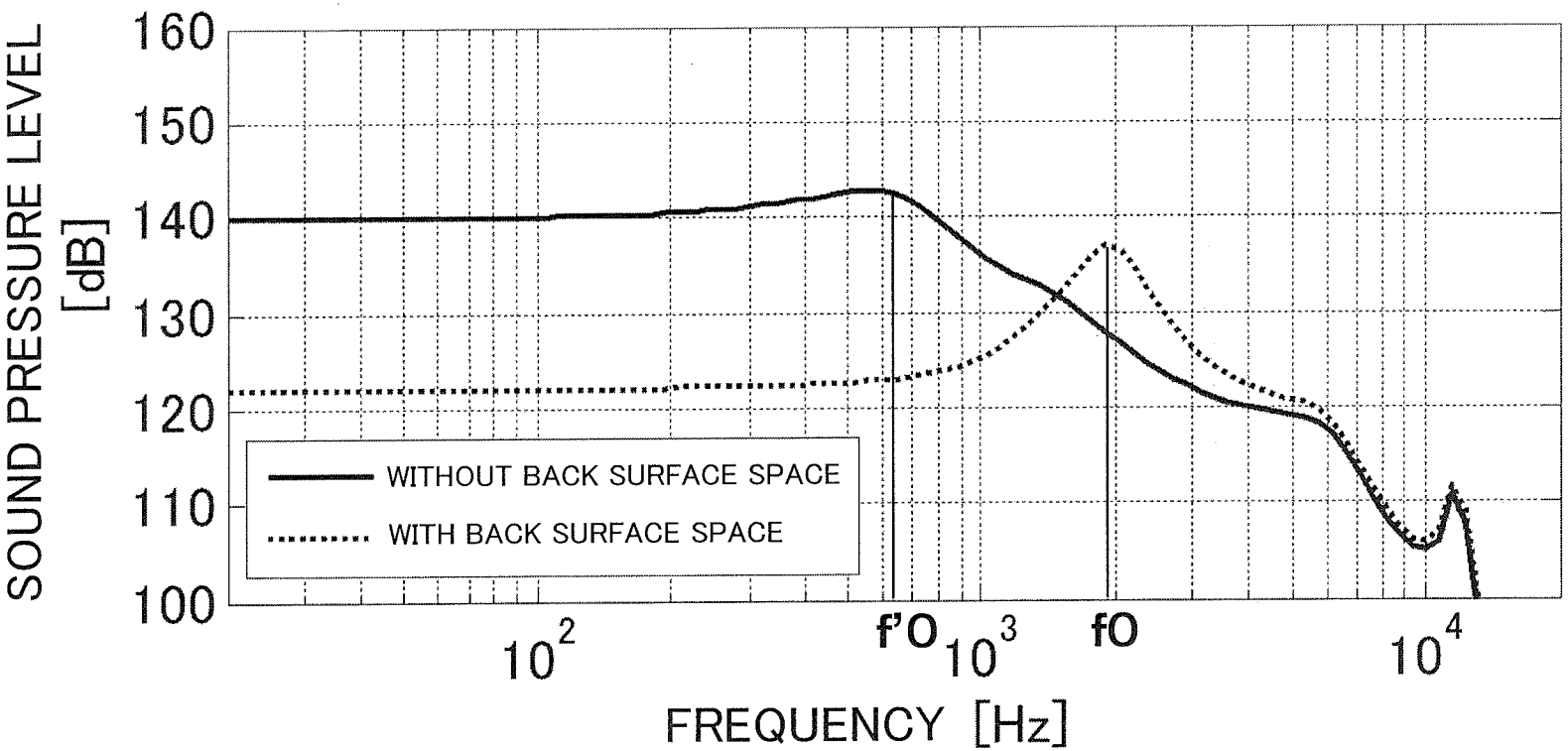
FIG. 16 PRIOR ART
FIG. 16 is a diagram showing the sound pressure frequency characteristics depending on presence/absence of a back surface space in the conventional earphone.

FIG. 16 is a diagram showing the sound pressure frequency characteristics depending on presence/absence of the back surface space in the conventional earphone 1000. In FIG. 16, a horizontal axis represents the frequency, and a vertical axis represents the sound pressure level. The sound pressure frequency characteristics in the state where no back surface space is provided (that is, in the configuration where the earphone 1000 has no back surface panel 1004) are represented by a solid line, while the sound pressure frequency characteristics in the state where a back surface space is provided (that is, in the configuration where the earphone 1000 has the back surface panel 1004) is represented by a dotted line. It can be confirmed from FIG. 16 that the back surface space provided in the earphone 1000 causes the minimum resonance frequency to increase from f'0 to f0, and enables adjustment of a difference between the sound pressure level in the frequency range lower than the minimum resonance frequency f0 and the sound pressure level in the frequency range higher than the minimum resonance frequency f0.

However, the above-mentioned conventional earphone 1000 has the following drawbacks. In the conventional earphone 1000, an undesirable peak is generated in the minimum resonance frequency f0. Further, in the conventional earphone 1000, in the frequency range lower than the minimum resonance frequency f0, the sound pressure level becomes constant, and therefore, the sound pressure frequency characteristics in the frequency range lower than the minimum resonance frequency f0 cannot be freely adjusted.

As a method of adjusting the sound pressure frequency characteristics, a method has been known, in which an air hole is formed through the back surface panel 1004 to adjust the airtightness inside the housing 1002. However, even in the method of providing the air hole through the back surface panel 1004, a peak that occurs when the minimum resonance frequency increases cannot be sufficiently suppressed, and the sound pressure frequency characteristics in the frequency range lower than the minimum resonance frequency f0 cannot be freely adjusted.

Therefore, the inventors of the present disclosure has devised an earphone capable of suppressing a peak that occurs when the minimum resonance frequency increases, and freely adjusting the sound pressure frequency characteristics in the frequency range lower than the minimum resonance frequency.

Various aspects of the present disclosure based on the newly devised earphone are as follows.

An earphone according to an aspect of the present disclosure includes: a loudspeaker unit; a sound conductive tube which is connected to a front surface having a diaphragm included in the loudspeaker unit, and has a hole through which a sound generated from the loudspeaker unit is emitted; a housing which is connected to a back surface of the loudspeaker unit so that a space is formed between the housing and the back surface of the loudspeaker unit, and has a first air hole connecting the space to external air; a first braking part which closes a sound hole of the loudspeaker unit; and a second braking part which closes the first air hole.

According to this aspect, a peak that occurs due to increase in the minimum resonance frequency can be suppressed by the first braking part, and furthermore, a sound quality suitable for the earphone can be realized by the degree of the braking effect of the second braking part.

In another aspect, for example, the first braking part and the second braking part are made of a nonwoven fabric or a woven fabric.

Further, in another aspect, for example, a third braking part that closes the hole of the sound conductive tube is further provided on the loudspeaker unit side of the sound conductive tube.

According to the another aspect, a resonance can be suppressed, which occurs due to the space formed between the diaphragm and the sound conductive tube and the mass of the air inside the sound conductive tube.

An earphone according to another aspect includes: a loudspeaker unit; a sound conductive tube which is connected to a surface opposite to a front surface having a diaphragm included in the loudspeaker unit, and has a hole through which a sound generated from the loudspeaker unit is emitted; a housing which is connected to a front surface of the loudspeaker unit so that a space is formed between the housing and the front surface of the loudspeaker unit, and has a first air hole connecting the space to external air; a back surface plate connected to the front surface of the loudspeaker unit, and has a second air hole; a first braking part which closes the second air hole; and a second braking part which closes the first air hole.

According to the another aspect, a peak that occurs due to increase in the minimum resonance frequency can be suppressed by the first braking part, and furthermore, a sound quality suitable for the earphone can be realized by the degree of the braking effect of the second braking part. Moreover, the high frequency characteristics can be improved by reducing the volume of the space formed between the diaphragm and the sound conductive tube.

Further, in another aspect, for example, the first braking part and the second braking part are made of a nonwoven fabric or a woven fabric.

Further, in another aspect, for example, a third braking part that closes the hole of the sound conductive tube is further provided on the loudspeaker unit side of the sound conductive tube.

According to the another aspect, a resonance can be suppressed, which occurs due to the space formed between the diaphragm and the sound conductive tube and the mass of the air inside the sound conductive tube.

Furthermore, in another aspect of the present disclosure, the above-mentioned earphone may be provided in a hearing aid.

Hereinafter, embodiments will be described in detail with reference to the drawings as appropriate. However, there will be instances in which detailed description beyond what is necessary is omitted. For example, detailed description of subject matter that is previously well-known, as well as redundant description of components that are substantially the same will in some cases be omitted. This is to prevent the following description from being unnecessarily lengthy, in order to facilitate understanding by a person of ordinary skill in the art. The applicant provides the following description and the accompanying drawings in order to allow a person of ordinary skill in the art to sufficiently understand the present disclosure, and the description and the drawings are not intended to restrict the subject matter of the scope of the patent claims.

Embodiment 1

Figure 1A:
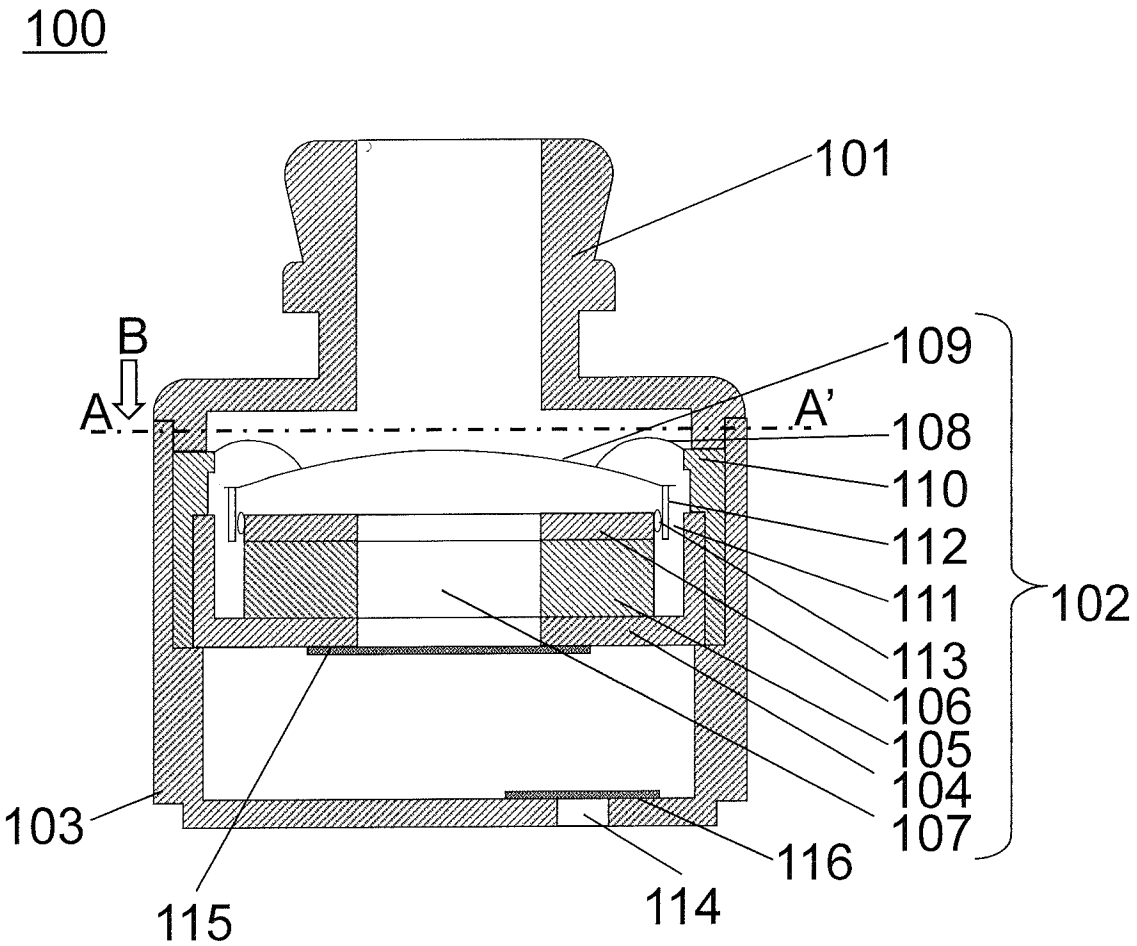
FIG. 1A is a schematic cross-sectional diagram showing the configuration of an earphone according to Embodiment 1 of the present disclosure.
Figure 1B:
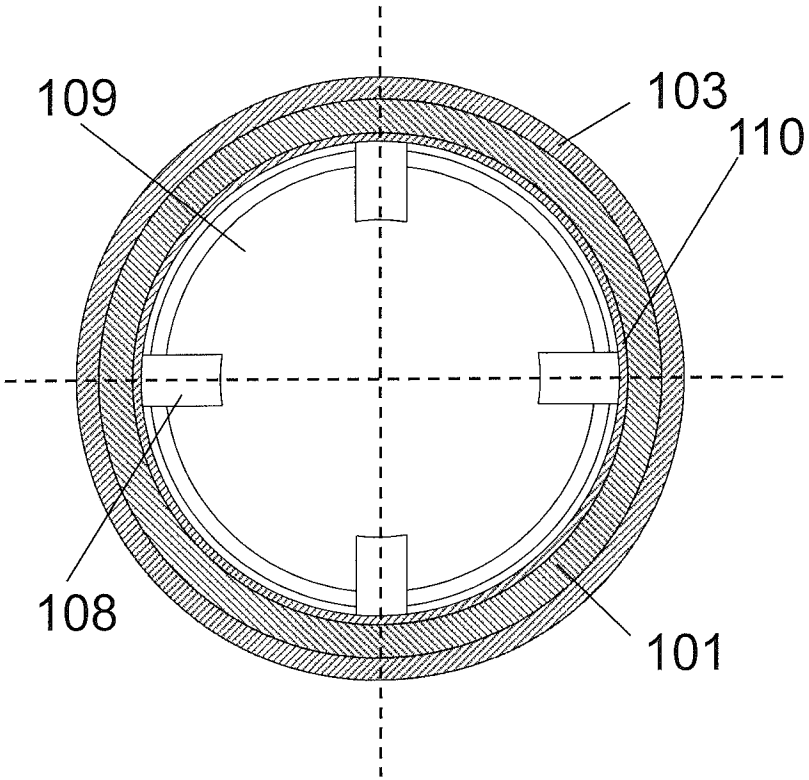
FIG. 1B is a schematic cross-sectional diagram taken along a line A-A' in FIG. 1A.

Hereinafter, Embodiment 1 will be described. Firstly, the configuration of an earphone 100 according to the present embodiment will be described. FIG. 1A is a schematic cross-sectional view of the earphone 100 according to the present embodiment. FIG. 1B is a schematic cross-sectional view taken along a line A-A' in FIG. 1A and viewed in the direction of an arrow B. The earphone 100 includes a sound conductive tube 101, a loudspeaker unit 102, a housing 103, a first braking part 115, and a second braking part 116 joined to the housing 103. The loudspeaker unit 102 includes a yoke 104, a magnet 105, a plate 106, a sound hole 107, support members 108 each having an arch-shaped cross section, a diaphragm 109 supported by the support members 108, a frame 110 to which the support members 108 are joined, a magnetic gap 111 produced by the yoke 104 and the plate 106, a voice coil 112 held in the magnetic gap 111, and a magnetic fluid 113 that fills a space between the plate 106 and the voice coil 112 in the magnetic gap 111. The first braking part 115 is joined to the yoke 104 so as to close the sound hole 107, and the second braking part 116 is joined to the housing 103 so as to close a first air hole 114 provided through the housing 103. Further, in the earphone 100, if the sound conductive tube 101 side is an upper side, a space between a lower surface of the yoke 104 and the housing 103 serves as a back surface space. In addition, the earphone 100 includes a plurality of support members 108 (in FIG. 1B, four support members 108), and the plurality of support members 108 partially support the diaphragm 109 in a vibratable manner.

Figure 2:
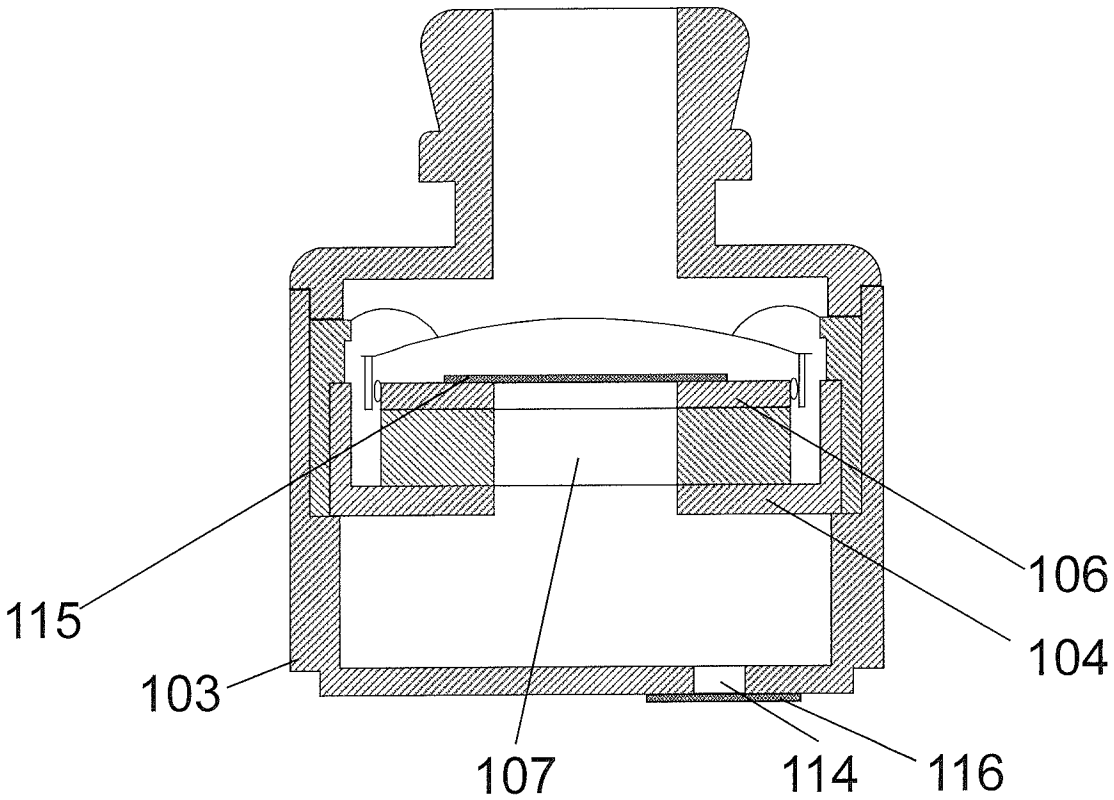
FIG. 2 is a schematic cross-sectional diagram showing the configuration of another example of the earphone according to Embodiment 1 of the present disclosure.

The first braking part 115 and the second braking part 116 may be made of any material, such as a braking fabric or a plurality of through-holes, so long as the braking effect can be added. For example, the first braking part 115 and the second braking part 116 are made of a material such as a mesh-type nonwoven fabric or woven fabric. Alternatively, for example, the first braking part 115 and the second braking part 116 may be made of a porous material that fills the sound hole 107 and the first air hole 114, respectively. Further, while in the present embodiment the first braking part 115 is joined to the yoke 104, the first braking part 115 may be joined to the plate 106 as shown in FIG. 2. Further, while in the present embodiment the second braking part 116 is joined to the inside of the earphone 100 in the housing 103, the second braking part 116 may be joined to the outside of the earphone 100 as shown in FIG. 2.

Figure 3:
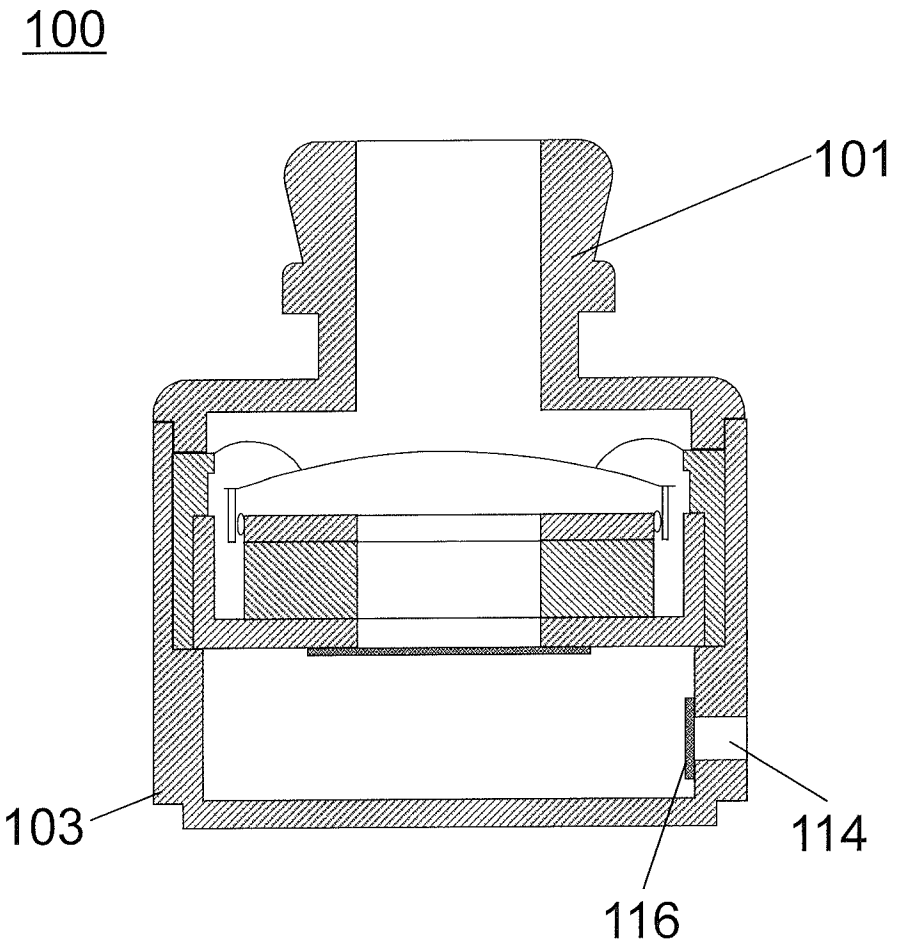
FIG. 3 is a schematic cross-sectional diagram showing the configuration of another example of the earphone according to Embodiment 1 of the present disclosure.

In the present embodiment, if the sound conductive tube 101 side is an upper side of the earphone 100, the first air hole 114 is provided on a bottom wall of the housing 103. However, the first air hole 114 may be provided on a side wall of the housing 103 as shown in FIG. 3. The position where the first air hole 114 is provided is not particularly limited, and the first air hole 114 may be provided at any position so long as it is not covered with an ear when the earphone 100 is inserted in the ear.

Next, the operation of the earphone 100 configured as described above, when it is inserted in an external auditory canal, will be described. When an electric signal is input to the voice coil 112, the voice coil 112 vibrates in accordance with the Fleming's left hand rule. Since the voice coil 112 is joined to the diaphragm 109, the diaphragm 109 vibrates in the same direction as the vibration of the voice coil 112. As a result, a sound wave is generated from the diaphragm 109. At this time, since the support members 108 do not enclose the entire circumference of the diaphragm 109 but are partially joined to the diaphragm 109, the compliance of the support members 108 is sufficiently high as compared to the conventional support member that encloses the entire circumference of the diaphragm 109, and thereby the minimum resonance frequency is reduced to several hundreds of Hz. However, since the loudspeaker unit 102 is joined to the housing 103, the compliance of the earphone 100 increases, and thereby the minimum resonance frequency increases. Simultaneously with this, a peak is generated in the minimum resonance frequency. However, this peak is reduced by the acoustic braking of the first braking part 115. Further, the sound pressure frequency characteristics in a frequency range lower than the minimum resonance frequency is determined by the acoustic braking of the second braking part 116. The above operation will be described in detail below.

Figure 4:
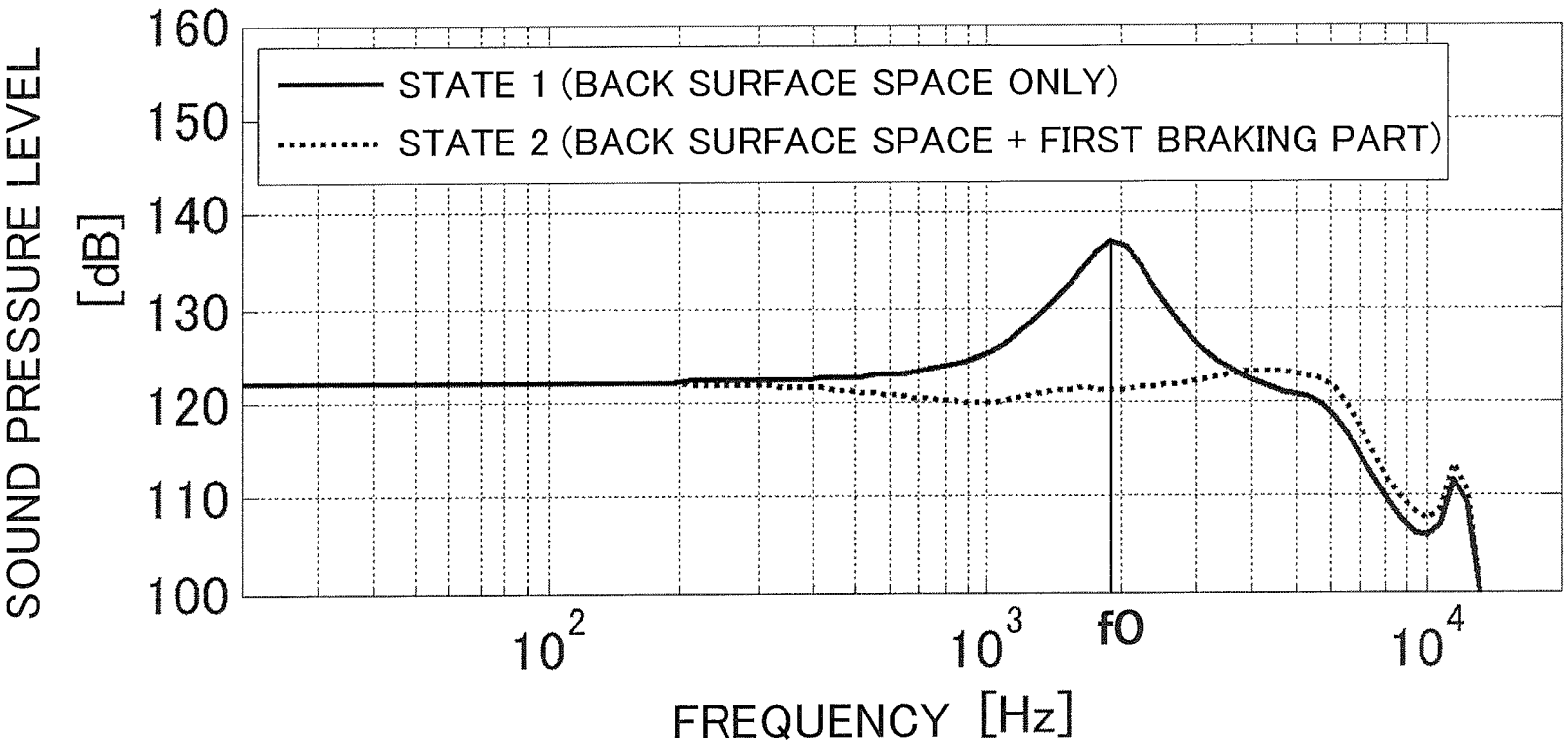
FIG. 4 is a diagram showing sound pressure frequency characteristics relating to a first braking part according to Embodiment 1 of the present disclosure.

FIG. 4 is a diagram showing the sound pressure frequency characteristics relating to the first braking part 115 of the earphone 100 according to the present embodiment. In FIG. 4, a horizontal axis represents the frequency, and a vertical axis represents the sound pressure level. The sound pressure frequency characteristics in state 1, wherein the sound conductive tube 101 side is a front side of the earphone 100, and only a space is provided on the back surface of the loudspeaker unit 102, is represented by a solid line. The sound pressure frequency characteristics in state 2, wherein a space and the first braking part 115 are provided on the back surface of the loudspeaker unit 102, is represented by a dotted line. As shown in FIG. 4, in the state 1 where only the space is provided on the back surface of the loudspeaker unit 102, a peak is generated in the minimum resonance frequency f0. However, by providing the first braking part 115 as in the state 2, the passing amount of sound of the minimum resonance frequency f0 can be adjusted, and thereby the peak in the minimum resonance frequency f0 can be suppressed.

Figure 5:
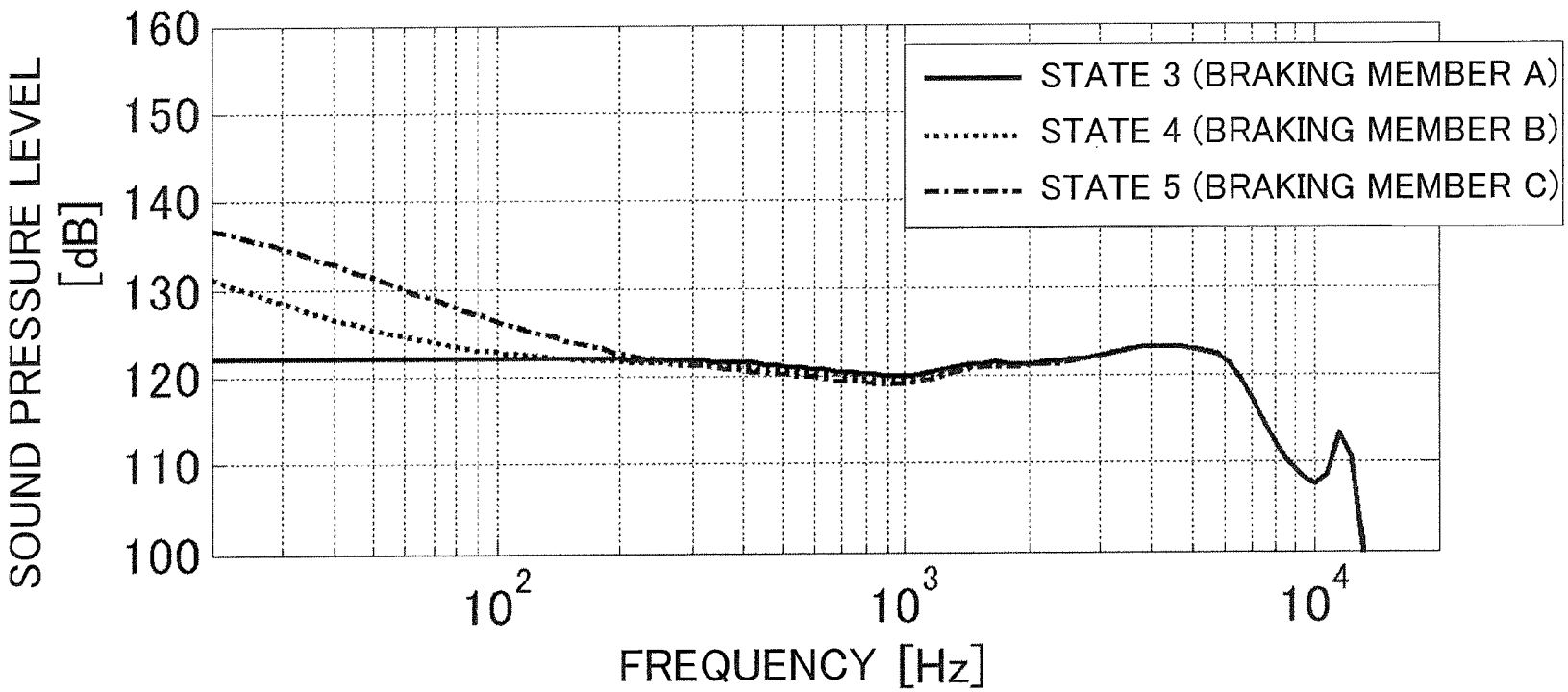
FIG. 5 is a diagram showing sound pressure frequency characteristics relating to a second braking part according to Embodiment 1 of the present disclosure.

Next, FIG. 5 is a diagram showing the sound pressure frequency characteristics relating to the second braking part 116 of the earphone 100 according to the present embodiment. In FIG. 5, a horizontal axis represents the frequency, and a vertical axis represents the sound pressure level. In FIG. 5, states 3, 4, and 5 represent the states where braking members A, B, and C are used as the second braking part 116 of the earphone 100, respectively. The braking members A, B, and C have the braking effects in descending order. The braking member A provides the substantially hermetically closed state where no sound passes through the first air hole 114, and the braking members B and C provide the states where sound is more difficult to pass through the first air hole 114 in this order. Further, in FIG. 5, the state 3 is represented by a solid line, the state 4 is represented by a dotted line, and the state 5 is represented by a dashed-dotted line. As shown in FIG. 5, by adjusting the magnitude of the braking effect of the second braking part 116, the amount of sound passing through the second braking part 116, which sound has frequencies lower than the minimum resonance frequency M, can be adjusted, and thereby the sound pressure frequency characteristics in the low frequency range can be adjusted.

As described above, in the present embodiment, also when the loudspeaker unit 102 having the low minimum resonance frequency is applied to the earphone 100, it is possible to realize the sound pressure frequency characteristics suitable for the earphone 100 by providing the back surface space, the first braking part 115, and the second braking part 116.

Further, when a braking fabric such as a mesh-type non-woven fabric or woven fabric is used as a material of the first braking part 115 and the second braking part 116, if the magnetic fluid 113 is scattered due to dropping impact or the like of the earphone 100, the braking fabric absorbs the magnetic fluid 113 to prevent the magnetic fluid 113 from flowing outside the earphone 100.

Figure 6:
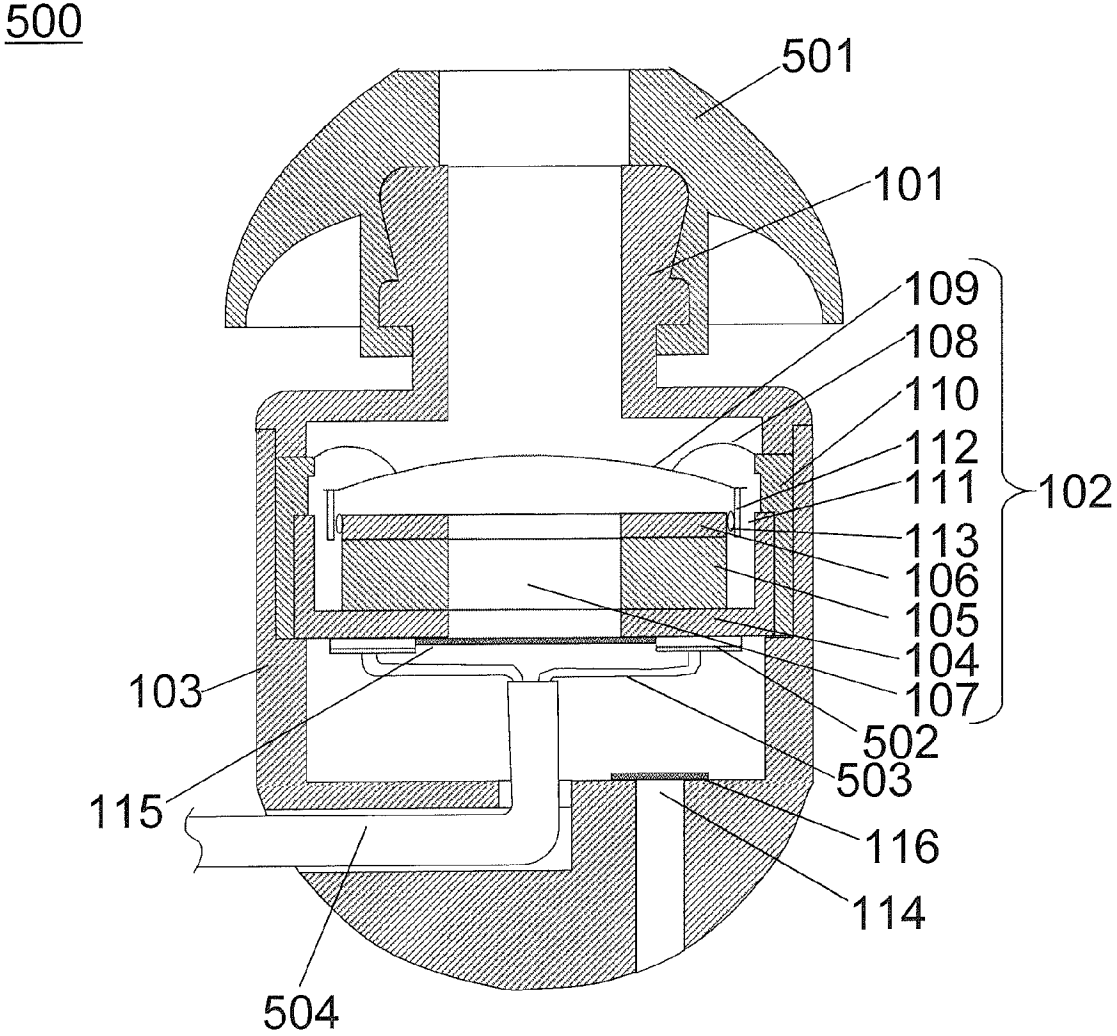
FIG. 6 is a schematic cross-sectional diagram showing the configuration of the earphone being used, according to Embodiment 1 of the present disclosure.

Next, an example of a case where the earphone 100 according to the present disclosure is actually used. FIG. 6 is a schematic cross-sectional diagram showing the configuration of the earphone 500 corresponding to the earphone 100 of the present embodiment which is actually used. The earphone 500 includes an ear chip 501, a terminal 502, wires 503, and a cord 504 having the wires 503 therein. A hole through which the cord 504 passes, which is formed through the housing 103, is hermetically closed by a rubber plug or the like (not shown). The internal configuration of the earphone 500 is identical to that of the above-mentioned earphone 100.

The operation of the earphone 500 configured as mentioned above, when it is fixed in an external auditory canal of a user via the ear chip 501, will be described. Since the voice coil 112 and the wires 503 are connected to the terminal 502, an electric signal outputted from equipment connected to the wires 503 is transmitted to the voice coil 112, and the voice coil 112 vibrates in accordance with the Fleming's left hand rule. Since the voice coil 112 is joined to the diaphragm 109, the diaphragm 109 vibrates in the same direction as the vibration of the voice coil 112. As a result, a sound wave is generated from the diaphragm 109. The generated sound wave reaches an eardrum of the user via the sound conductive tube 101, the ear chip 501, and the external auditory canal, and thereby the user perceives the sound wave. In the present embodiment, by providing the back surface space, the first braking part 115, and the second braking part 116, even the loudspeaker unit 102 having the low minimum resonance frequency can realize the sound pressure frequency characteristics suitable for the earphone 500, and therefore, the user of the earphone 500 is provided with high sound quality.

While in the present embodiment the support members 108 supporting the diaphragm 109 are partially joined to the diaphragm 109, a support member 108 may be joined to the entire circumference of the diaphragm 109. The magnetic fluid 113 is provided to prevent a sound wave having a phase opposite to the phase of the sound wave generated from the diaphragm 109 toward the sound conductive tube 101, from traveling from a surface of the diaphragm 109 on the side opposite to the sound conductive tube 101 toward the sound conductive tube 101. If a support member 108 is joined to the entire circumference of the diaphragm 109, the support member 108 and the diaphragm 109 prevent a sound wave having a phase opposite to the phase of the sound wave generated from the diaphragm 109 toward the sound conductive tube 101, from traveling from a surface of the diaphragm 109 on the side opposite to the sound conductive tube 101 toward the sound conductive tube 101. Therefore, the magnetic fluid 113 is not an indispensable component in the present disclosure. That is, the magnetic fluid 113 may be removed from the components of the earphone 100, and the support member 108 may be joined to the entire circumference of the diaphragm 109.

Figure 7:
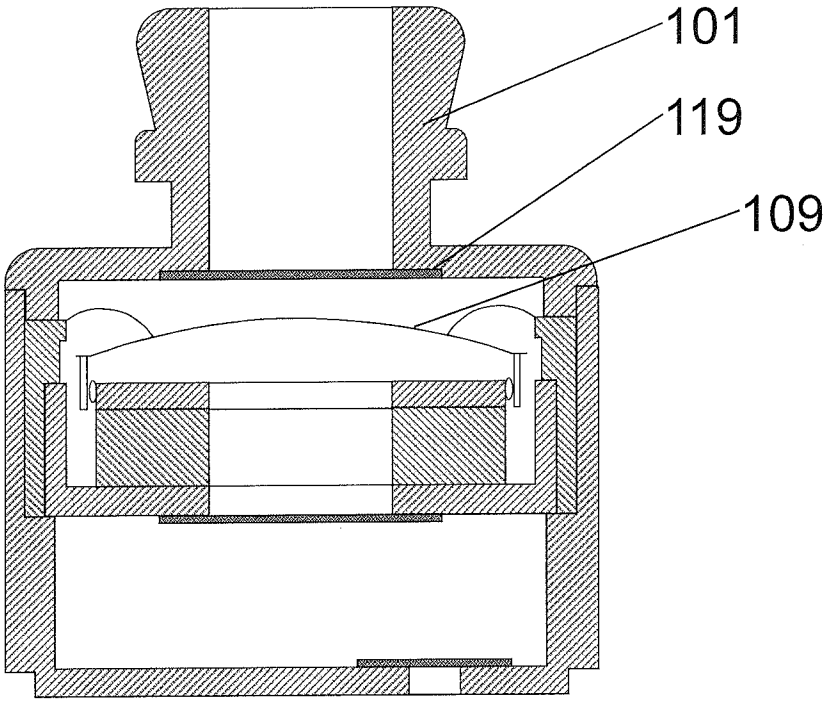
FIG. 7 is a schematic cross-sectional diagram showing the configuration of another example of the earphone according to Embodiment 1 of the present disclosure.

Further, as shown in FIG. 7, in the present embodiment, a third braking part 119 joined to the sound conductive tube 101 may be provided in order to suppress a resonance that occurs due to the space formed between the diaphragm 109 and the sound conductive tube 101 and the mass of the air inside the sound conductive tube 101.

Embodiment 2

Figure 8:
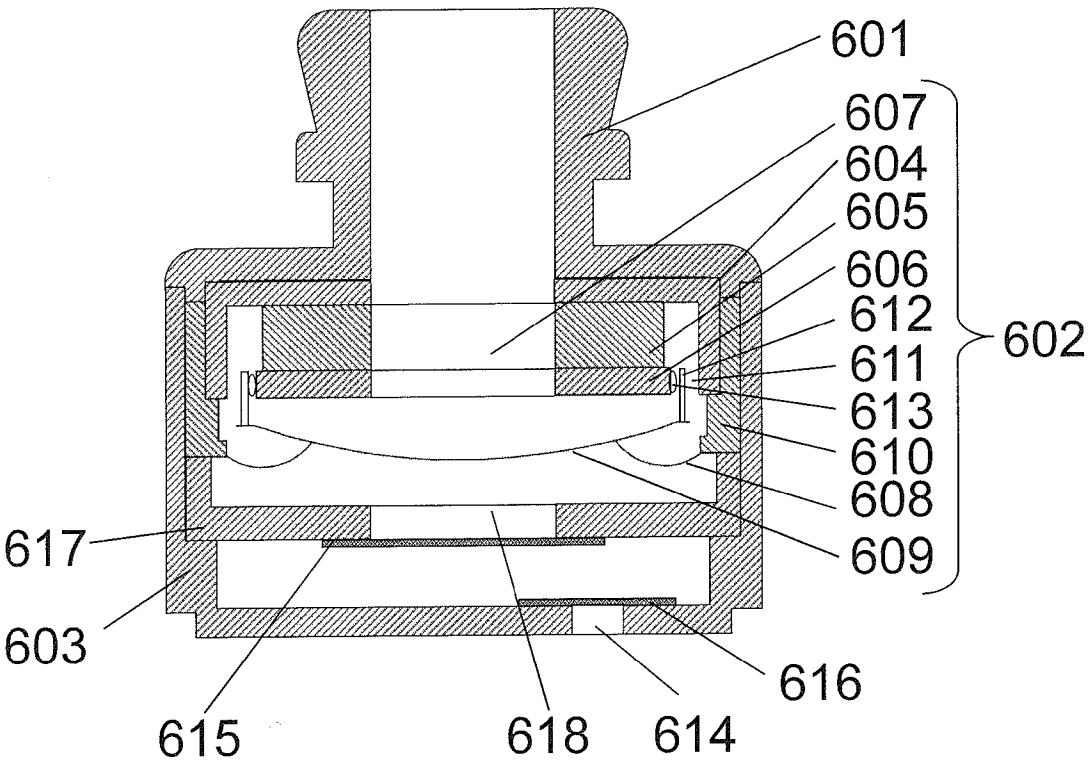
FIG. 8 is a schematic cross-sectional diagram showing the configuration of an earphone according to Embodiment 2 of the present disclosure.

Hereinafter, an earphone 600 according to Embodiment 2 will be described. The earphone 600 is characterized by that, in the earphone 100 of the Embodiment 1, if the sound conductive tube 101 side is an upper side, the loudspeaker unit 102 is inverted so that the diaphragm 109 faces the bottom wall of the housing 103, and a back surface plate through which a second air hole is formed is provided inside the housing, and the first braking part is joined to the back surface plate so as to close the second air hole. FIG. 8 is a schematic cross-sectional view of the earphone 600 according to the present embodiment. The earphone 600 includes a sound conductive tube 601, a loudspeaker unit 602, a housing 603, a back surface plate 617, a first braking part 615 joined to the back surface plate 617 so as to close a second air hole 618 provided through the back surface plate 617, and a second braking part 616 joined to the housing 603 so as to close a first air hole 614 provided through the housing 603. The loudspeaker unit 602 includes a yoke 604, a magnet 605, a plate 606, a sound hole 607, support members 608 each having an arch-shaped cross section, a diaphragm 609 supported by the support members 608, a frame 610 joined to the support members 608, a magnetic gap 611 produced by the yoke 604 and the plate 606, a voice coil 612 held in the magnetic gap 611, and a magnetic fluid 613 that fills a space between the plate 606 and the voice coil 612 in the magnetic gap 611. In addition, the back surface plate 617 is joined to the frame 610.

Next, the operation of the earphone 600 thus configured when it is inserted in an external auditory canal of a user will be described. Like in Embodiment 1, when an electric signal is input to the voice coil 612, the voice coil 612 vibrates, and a sound wave is generated from the diaphragm 609. Embodiment 2 is greatly different from Embodiment 1 in that the sound wave having passed through the sound hole 607 travels toward the external auditory canal of the user via the sound conductive tube 601. The earphone 600 thus configured realizes reduction in the volume of the space formed between the diaphragm 609 and the sound conductive tube 601, as compared to Embodiment 1. That is, in the earphone 600, the volume of a space formed between the diaphragm 609 and the sound conductive tube 601 is reduced to the volume of a space formed between the diaphragm 609 and the sound hole 607. Since the space formed between the diaphragm 609 and the sound conductive tube 601 serves to reduce the high frequency characteristics, the high frequency characteristics can be improved in the present embodiment as compared to Embodiment 1. However, when the configuration of the present embodiment is realized, if the sound conductive tube 601 side is a front side of the earphone 600, the first braking part 615 cannot be provided in the back surface space of the loudspeaker unit 602. Therefore, the back surface plate 617 is provided inside the housing 603 and on the back surface side of the loudspeaker unit 602, and the first braking part 615 is joined so as to close the second air hole 618 formed through the back surface plate 617.

Figure 9:
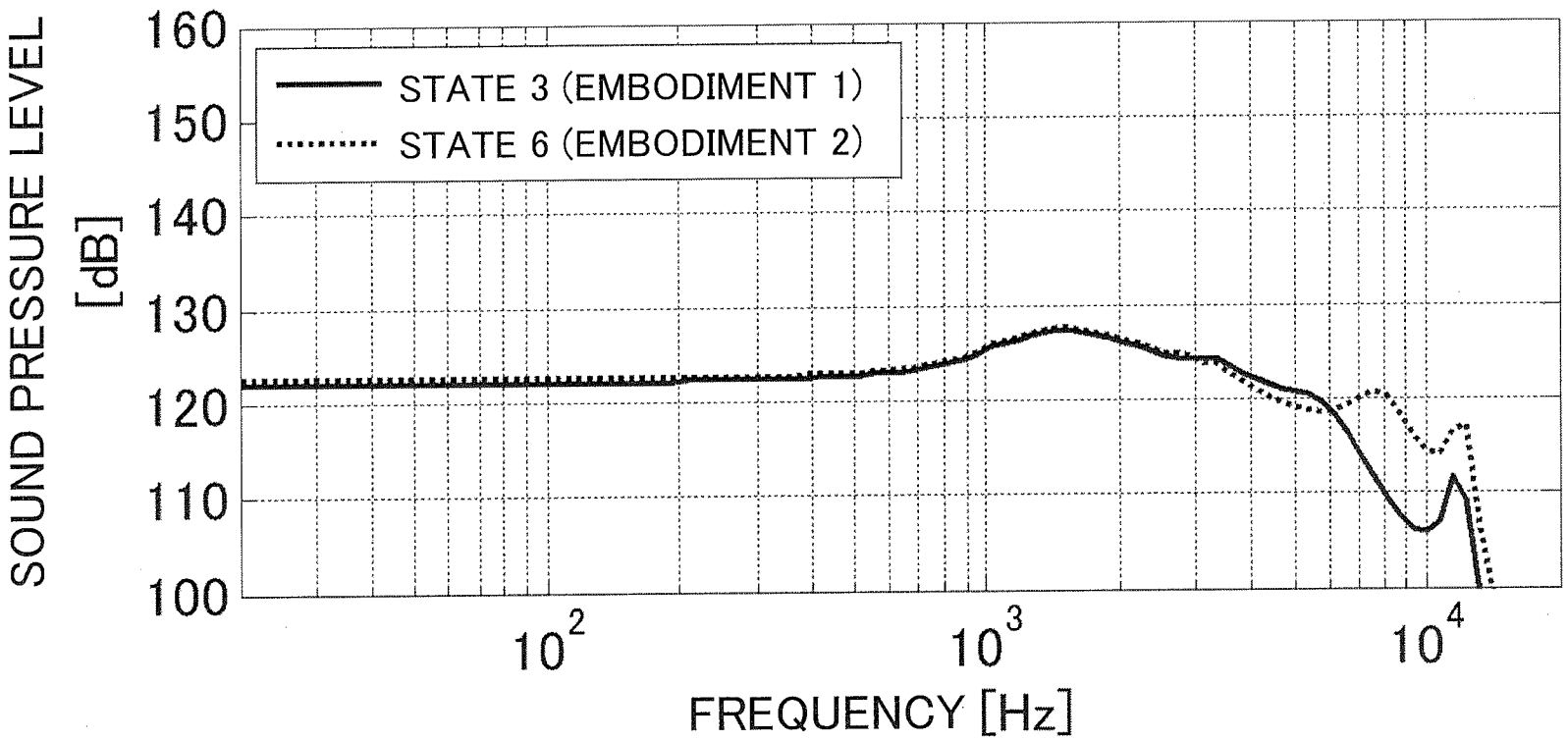
FIG. 9 is a diagram showing sound pressure frequency characteristics of the earphone according to Embodiment 2 of the present disclosure.

FIG. 9 is a diagram showing the sound pressure frequency characteristics of the earphone 600 according to the present embodiment. In FIG. 9, a horizontal axis represents the frequency, and a vertical axis represents the sound pressure level. The sound pressure frequency characteristics of the state 3 shown in Embodiment 1 is represented by a solid line, and the sound pressure frequency characteristics of a state 6 according to the present embodiment is shown by a dotted line. The first braking part 115 of the state 3 and the first braking part 615 of the state 6 are implemented by a braking member having the same braking effect, and the second braking part 116 of the state 3 and the second braking part 616 of the state 6 are implemented by a braking member having the same braking effect. It can be confirmed from FIG. 9 that the high frequency characteristics in the vicinity of $8\times10^3$ Hz to $1\times10^4$ Hz are increased by about 10 dB in the state 6 as compared to the state 3. Accordingly, it is found that the high frequency characteristics can be improved by reducing the volume of the space formed between the diaphragm 609 and the sound conductive tube 601.

Figure 10:
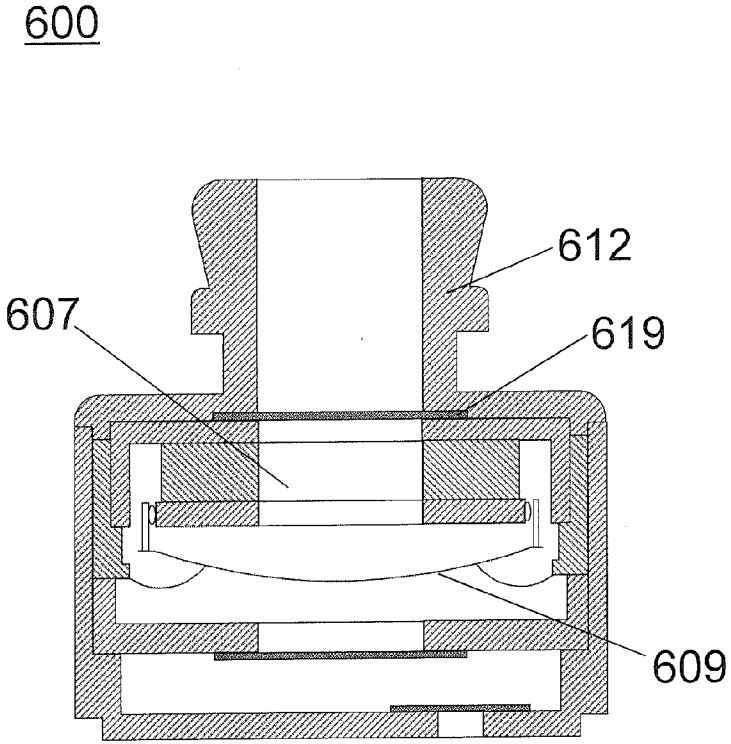
FIG. 10 is a schematic cross-sectional diagram showing the configuration of another example of the earphone according to Embodiment 2 of the present disclosure.

As shown in FIG. 10, in the present embodiment, a third braking part 619 joined to the sound conductive tube 601 may be provided in order to suppress a resonance that occurs due to the space formed between the diaphragm 609 and the sound hole 607 and the mass of the air inside the sound conductive tube 601.

Embodiment 3

Figure 11:
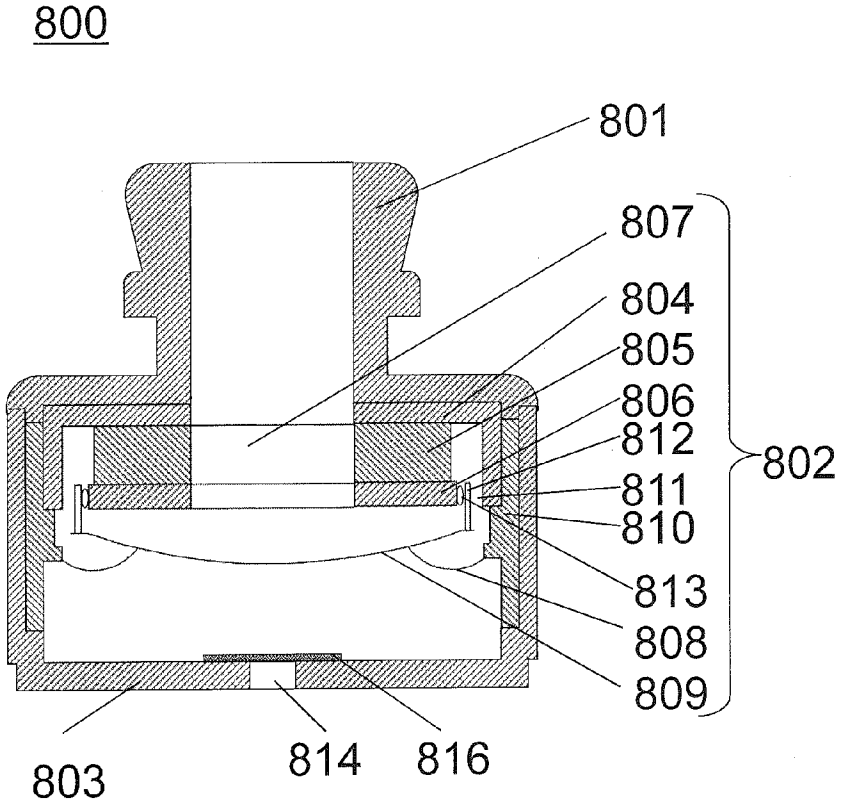
FIG. 11 is a schematic cross-sectional diagram showing the configuration of an earphone according to Embodiment 3 of the present disclosure.

Hereinafter, an earphone 800 according to Embodiment 3 will be described. The earphone 800 is characterized by that, in the earphone 600 of the Embodiment 2, the back surface plate 617 having the second air hole 618 and the first braking part 615 are not provided. FIG. 11 is a schematic cross-sectional view of the earphone 800 according to the present embodiment. The earphone 800 includes a sound conductive tube 801, a loudspeaker unit 802, a housing 803, and a second braking part 816 joined to the housing 803 so as to close a first air hole 814 provided through the housing 803. The loudspeaker unit 802 includes a yoke 804, a magnet 805, a plate 806, a sound hole 807, support members 808 each having an arch-shaped cross section, a diaphragm 809 supported by the support members 808, a frame 810 joined to the support members 808, a magnetic gap 811 formed by the yoke 804 and the plate 806, a voice coil 812 held inside the magnetic gap 811, and a magnetic fluid 813 that fills a space between the plate 806 and the voice coil 812 in the magnetic gap 811.

Next, the operation of the earphone 800 thus configured when it is inserted in an external auditory canal of a user will be described. Like Embodiment 2, an electric signal is input to the voice coil 812, the voice coil 812 vibrates, and a sound wave is generated from the diaphragm 809. Embodiment 3 is greatly different from Embodiment 2 in that the first braking part is not provided. In Embodiment 2, in order to improve the high frequency characteristics, the diaphragm 609 protrudes to the side opposite to the sound conductive tube 601 to reduce the volume of the space formed between the diaphragm 609 and the sound conductive tube 601. In the configuration of Embodiment 2, however, the back surface plate 617 needs to be provided inside the housing 603 in order to provide the first braking part 615. Accordingly, implementation of Embodiment 2 has a problem that the number of components increases. So, in the present embodiment, instead of providing the first braking part and the back surface plate as means to suppress a peak in the minimum resonance frequency, the viscosity of the magnetic fluid 813 is utilized, and thereby the number of components is reduced.

Figure 12:
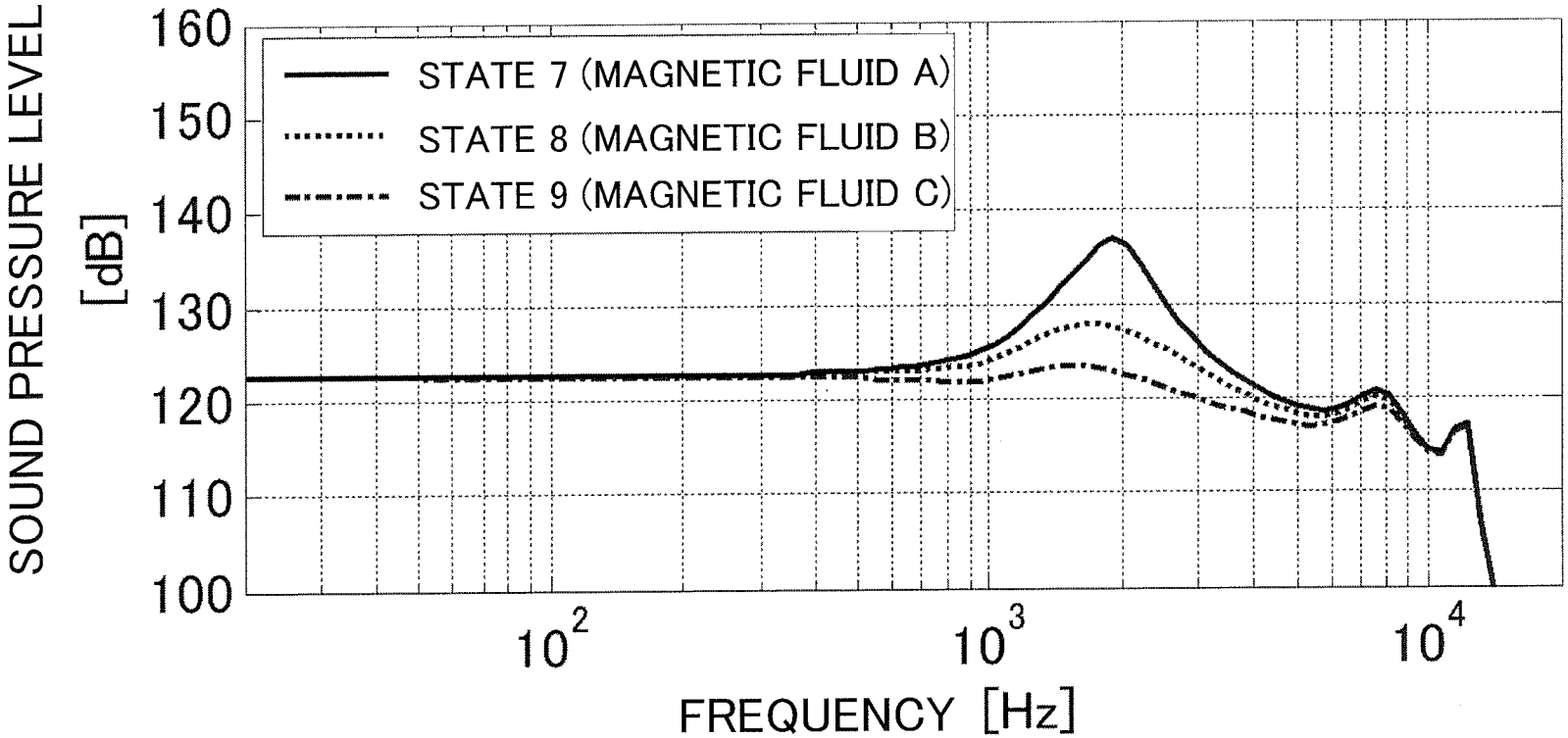
FIG. 12 is a diagram showing sound pressure frequency characteristics of the earphone according to Embodiment 3 of the present disclosure.

FIG. 12 is a diagram showing the sound pressure frequency characteristics of the earphone 800. In FIG. 12, states 7, 8, and 9 show the states where magnetic fluids A, B, and C are used as the magnetic fluid 813 of the earphone 800, respectively. The magnetic fluids A, B, and C have the viscosities in ascending order. Further, in FIG. 12, the state 7 is represented by a solid line, the state 8 is represented by a dotted line, and the state 9 is represented by a dashed-dotted line. It is found from FIG. 12 that the peak in the minimum resonance frequency can be suppressed by increasing the viscosity of the magnetic fluid 813. Accordingly, in the present embodiment, even in the state where the first braking part is omitted, the peak in the minimum resonance frequency can be suppressed as in Embodiment 2 by adjusting the viscosity of the magnetic fluid 813, and therefore, the number of components can be reduced. While in the present embodiment the magnetic fluid 813 is injected into the area surrounded by the plate 806 and the voice coil 812 in the magnetic gap 811, the magnetic fluid 813 may be injected into the entirety of the magnetic gap 811 in order to enhance the braking effect. Further, the braking effect can be enhanced by bringing the voice coil 812 and the plate 806 closer to each other.

Figure 13:
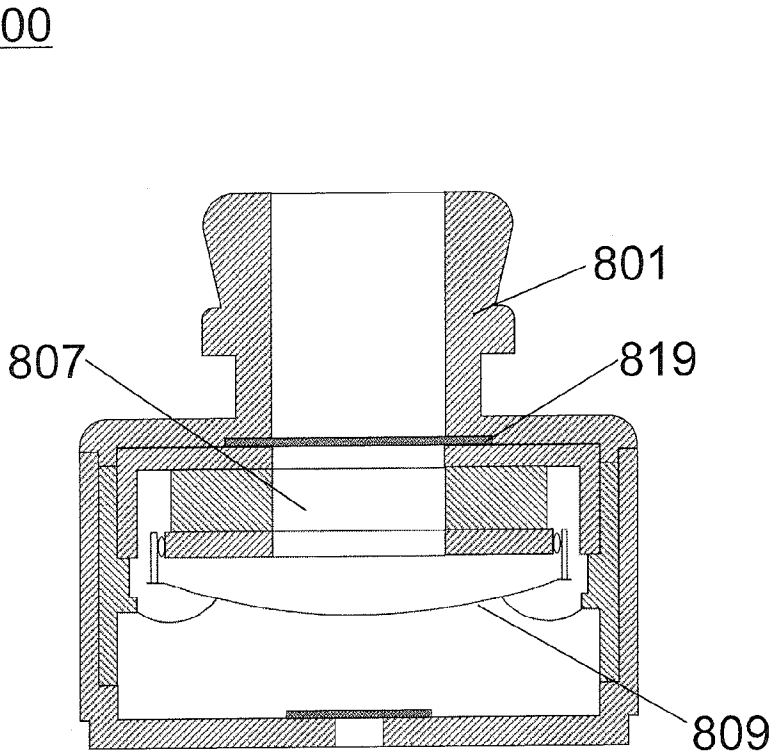
FIG. 13 is a schematic cross-sectional diagram showing the configuration of another example of the earphone according to Embodiment 3 of the present disclosure.

As shown in FIG. 13, in the present embodiment, a third braking part 819 joined to the sound conductive tube 801 may be provided in order to suppress a resonance that occurs due to the space formed between the diaphragm 809 and the sound hole 807 and the mass of the air inside the sound conductive tube 801.

In Embodiments 1 to 3, if the accuracy of a technique of forming submicron holes is improved, submicron holes may be formed through the housing and the back surface plate as the first air hole and the second air hole, respectively. Also in this case, it is possible to achieve the same braking effect as that achieved by the configuration including the first braking part and the second braking part.

(Installation Example)

Figure 14:
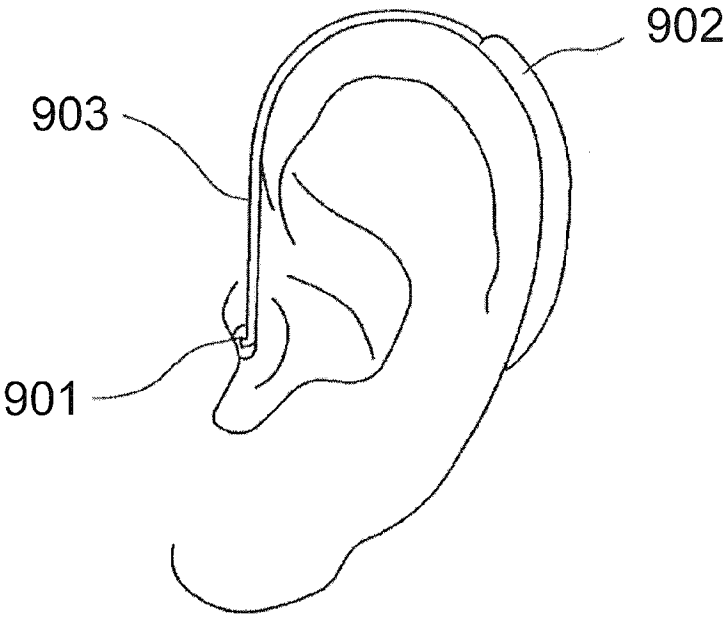
FIG. 14 is a diagram showing an example of an external view of a hearing aid according to Installation Example of the present disclosure.

FIG. 14 is a diagram showing an external view of a hearing aid in which any of the earphones according to Embodiments 1 to 3 is installed. With reference to FIG. 14, a hearing aid according to the present installation example will be described. The hearing aid shown in FIG. 14 includes a receiver part 901, a hearing aid body 902, and a lead tube 903. The configuration of the receiver part 901 is based on the configuration of the earphone according to any of Embodiments 1 to 3.

According to the hearing aid of the present installation example, since the receiver part 901 has the configuration of the earphone of the present disclosure, it is possible to provide a small-size hearing aid which causes a user to feel less discomfort when it is inserted in his/her ear, suppresses a peak that occurs when the minimum resonance frequency increases, freely adjusts the sound pressure frequency characteristics in the frequency range lower than the minimum resonance frequency, and is adaptable to various users who need different sound pressure frequency characteristics.

As described above, according to the present disclosure, even the earphone using the loudspeaker unit having the low minimum resonance frequency can provide the sound pressure frequency characteristics in which the frequency range lower than the minimum resonance frequency and the frequency range higher than the minimum resonance frequency are well balanced. Thereby, high sound quality can be achieved in earphones of hearing aids, portable music players, and the like.

INDUSTRIAL APPLICABILITY

The earphone according to the present disclosure is applicable to AV equipment such as hearing aids, portable music players, and the like.

DESCRIPTION OF THE REFERENCE CHARACTERS

100, 500, 1000 earphone
101, 601 sound conductive tube
102, 602, 1001 loudspeaker unit
103, 603, 1002 housing
104, 604, 804 yoke
105, 605, 805 magnet
106, 606, 806 plate
107, 607, 807 sound hole
108, 608, 808 support member
109, 609, 809 diaphragm
110, 610, 810 frame
111, 611, 811 magnetic gap
112, 612, 812 voice coil
113, 613, 813 magnetic fluid
114, 614, 814 first air hole
115, 615 first braking part
116, 616, 816 second braking part
119, 619, 819 third braking part
501 ear chip
502 terminal
503 wires
504 cord
617 back surface plate
618 second air hole
901 receiver part
902 hearing aid body
903 lead tube
1003 sound output hole
1004 back surface panel

The invention claimed is:

1. An earphone, comprising:

a loudspeaker unit including a magnet, a yoke fixed to a back surface of the magnet, a plate having a back surface fixed to a front surface of the magnet, and a diaphragm disposed on a side of a front surface of the plate, a back surface of the diaphragm and the front surface of the plate having a first space formed therebetween;

a sound conductive tube which is connected to a back surface of the loudspeaker unit, the sound conductive tube having a hole connected to outside the earphone;

a sound hole penetrating the plate, the magnet, and the yoke, the sound hole and the hole in the sound conductive tube connecting the first space to outside the earphone;

a housing which is connected to a front surface of the loudspeaker unit, the housing and the front surface of the loudspeaker unit having a second space formed therebetween, and the housing being penetrated by a singlet air hole that connects the second space to outside the earphone;

a back surface plate, disposed inside the housing, dividing the second space into a space on a side of the loudspeaker unit and a space on a side of the single air hole, the back surface plate having another air hole that connects the space on the side of the loudspeaker unit to the space on the side of the single air hole;

a first braking member which closes the other air hole and is joined to the back surface plate; and a second braking member which is joined to the housing to close the single air hole and to reduce the passing amount of sound.

2. The earphone according to claim 1, wherein the loudspeaker unit further comprises:

a circular voice coil joined to the diaphragm; and a magnetic fluid filling a third space between an inner peripheral surface of the voice coil and an outer peripheral surface of the plate, wherein a magnetic gap is formed between the plate and the yoke, and the voice coil is held in the magnetic gap.

3. The earphone according to claim 2, wherein the magnetic fluid fills the third space, so that the first space is partitioned by (i) the diaphragm, (ii) the voice coil, (iii) the magnetic fluid, and (iv) the plate, and the sound hole and the sound conductive tube are connected to each other to form a third air hole, and the third air hole connects the first space to outside the earphone.

4. The earphone according to claim 3, wherein the first space is partitioned only by (i) the diaphragm, (ii) the voice coil, (iii) the magnetic fluid, and (iv) the plate.

5. The earphone according to claim 1, wherein the first braking member and the second braking member are made of a nonwoven fabric or a woven fabric.

6. The earphone according to claim 1, further comprising:

a third braking member which is provided on a loudspeaker unit side of the sound conductive tube, and closes the hole of the sound conductive tube.

* * * * *